United States Patent [19]

Okuno

[11] Patent Number: 4,839,476

[45] Date of Patent: Jun. 13, 1989

[54] SWITCH OPERATING MECHANISM

[75] Inventor: Michiharu Okuno, Hyogo, Japan

[73] Assignee: Mitsubishi Denki Kabushiki Kaisha, Japan

[21] Appl. No.: 201,720

[22] Filed: Jun. 3, 1988

[30] Foreign Application Priority Data

Jun. 4, 1987 [JP] Japan ..... 62-140201

[51] Int. Cl.[4] ..... H01H 3/00; H01H 5/00

[52] U.S. Cl. ..... 200/17 R; 200/400

[58] Field of Search ..... 200/17 R, 153 SC, 18, 200/400

[56] References Cited

U.S. PATENT DOCUMENTS 4,256,941 3/1981 Bachler ..... 200/153 SC

FOREIGN PATENT DOCUMENTS 55-17449 5/1980 Japan .
60-9142 1/1985 Japan .
61-96619 5/1986 Japan .

*Primary Examiner*—J. R. Scott
*Attorney, Agent, or Firm*—Sughrue, Mion, Zinn, Macpeak & Seas

[57] ABSTRACT

In a switch operating mechanism in which the elastic force of a spring energized is transmitted through a link mechanism to achieve a switch opening or closing operation, one end of a first torsion bar is fixedly secured to a rotatable member while the other end is fixedly secured to a stationary part of the mechanism, and one end of a second torsion bard is fixedly secured to the rotatable member in such a maner that the one end is diametrically opposite to the one end of the first torsion bar while the other end is rotatably supported by the stationary part and coupled to the link mechanism.

2 Claims, 4 Drawing Sheets

SWITCH OPERATING MECHANISM

BACKGROUND OF THE INVENTION

This invention relates to a switch operating mechanism.

Application of coil springs to spring type operating mechanisms for circuit breakers have been disclosed by Japanese Patent Application (OPI) No. 96619/1986 (the term "OPI" as used herein means an "Unexamined published application"), Japanese Patent Application Publication No. 17449/1980, and Japanese Utility Model Application (OPI) No. 9142/1985.

One example of a conventional spring type operating mechanism is as shown in FIG. 6.

In FIG. 6, a housing 1 includes a a cam shaft 2 supported on the housing. A cam 3 is mounted on the cam shaft 2. A ratchet wheel 4 is mounted on the cam shaft 2. A making spring 5 is provided for generating torque to turn the cam shaft 2 clockwise. A lever 6 is rotatably supported on the housing 1 through a shaft 7, the lever 6 having a pin 8 and a roller 9. A breaking spring 10 is coupled to the lever 6 (being compressed in the case of FIG. 6). A pawl shaft 11 is coupled through a gear (not shown) to an electric motor (not shown). When the making spring 5 is at the deenergization position, the motor (not shown) is rotated to permit the eccentric motion of the pawl shaft 11.

Further in FIG. 6, reference numeral 12 designates pawls mounted on the pawl shaft 11, which rock as the pawl shaft 11 rotates. A pin 13 is provided on the ratchet wheel 4 and making latch 14 is engaged with the pin 13. A making trigger 15 is engaged with the making latch 14. A making electromagnet 16 is provided having a plunger 17. A tripping latch 18 is engaged with the pin 8. A tripping trigger 19 is engaged with the tripping latch 18. A tripping electromagnet 20 with a plunger 21 is provided. The movable contactor 22 of the circuit breaker is coupled through a link mechanism 23 to the lever 6.

The circuit opening operation of the spring type operation mechanism thus constructed will be described.

In FIG. 6, the lever 6 is biased in the clockwise direction by means of the breaking spring 10, but it is held by the tripping latch 18 and the tripping trigger 19. Therefore, when, under this condition, the tripping electromagnet 20 is energized to turn the tripping trigger 19 counterclockwise, then the tripping latch 18 is disengaged from the pin 8, as a result of which the lever 6 is turned clockwise, and the movable contactor 22 is moved to open the circuit with the aid of the link mechanism 23, as shown in FIG. 7.

Now, the circuit closing operation will be described. In FIG. 7, torque is applied to the cam shaft 2 by the making spring 5 coupled to the ratchet wheel 4 so that the cam shaft 2 is turned clockwise, and the torque is maintained by the making latch 14 and the making trigger 15. Therefore, when, under this condition, the making electromagnet is energized to turn the making trigger 15 counterclockwise, the latch 14 is disengaged from the pin 13 of the ratchet wheel 4, as a result of which the cam 3, which is fixedly mounted on the cam shaft 2, is turned clockwise while the lever 6 is turned counterclockwise while compressing the breaking spring 10. FIG. 8 shows a state of the spring type operating mechanism in which the circuit closing operation has been accomplished and the pin 8 is held by the tripping latch 18.

The making spring is energized as follows: As shown in FIG. 8, when the circuit closing operation has ended, the making spring 5 is in a deenergized condition. The pawl shaft 11 is coupled through the gear (not shown) to the motor (not shown), and when the making spring 5 is in the deenergized condition, the motor is started to turn the pawl shaft 11. In this operation, since the pawl shaft 11 is eccentric, the two pawls 12 mounted on the pawl shaft 11 rock. By this rocking operation, the ratchet wheel 4 is turned clockwise to energize the making spring 5. At a position over the dead point, clockwise torque is applied to the cam shaft 2, and the making latch 14 is engaged with the pin 13 as shown in FIG. 6. Under this condition, the pawls are confronted with the part of the ratchet wheel 4 which has no teeth, and therefore even if the pawls 12 rock, no torque is applied to the ratchet wheel 4, and the pawl shaft 11 is not turned, so that the rotation of the motor gives no overload to the pawls 12 or the making latch 14.

As is apparent from the above description, in the conventional switch operating mechanism thus constructed, the elastic force, in the linear direction, of the compressed coil spring is converted into torque with the aid of the lever. Therefore, the switch operating mechanism suffers from a problem in that it is difficult to operate the movable contactor at high speed.

SUMMARY OF THE INVENTION

Accordingly, an object of this invention is to eliminate the above-described problem accompanying a conventional switch operating mechanism.

More specifically, an object of the invention is to provide a switch operating mechanism in which a force for driving the movable contactor is obtained directly as torque.

The foregoing object and other objects of the invention have been achieved by the provision of a switch operating mechanism in which the elastic force of an energized spring is transmitted through a link mechanism to achieve a switch opening or closing operation, which, according to the invention, comprises: a first torsion bar having one end which is fixedly secured to a rotatable member, and the other end which is fixedly secured to a stationary part of said mechanism; and a second torsion bar having one end which is fixedly secured to the rotatable member in such a manner that the one end of the first and second torsion bars are positioned diametrically opposite to each other on the rotatable member, and the other end is rotatably supported by the stationary part and is coupled to the link mechanism.

The nature, principle and utility of the invention will become more apparent from the following detailed description when read in conjunction with the accompanying drawings.

DETAILED DESCRIPTION OF THE INVENTION

One example of a switch operating mechanism according to the invention will be described with reference to the accompanying drawings.

Figure 1:
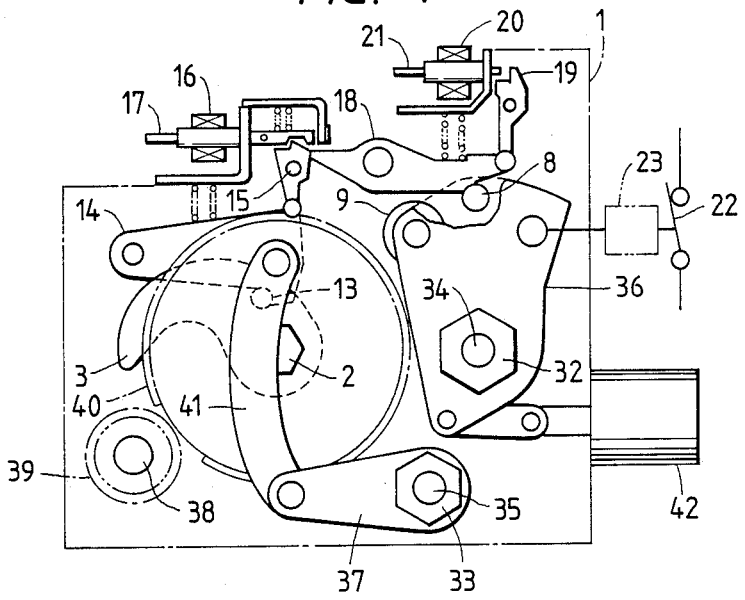
FIG. 1 is a front view showing one example of a switch operating mechanism according to this invention.
Figure 3:
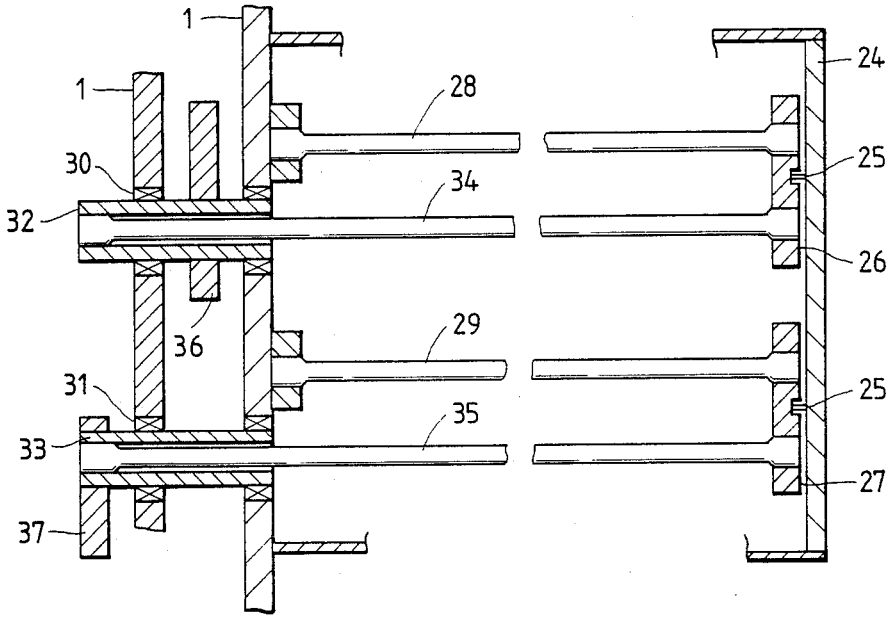
FIG. 3 is a sectional view of essential components of the switch operating mechanism.
Figure 2:
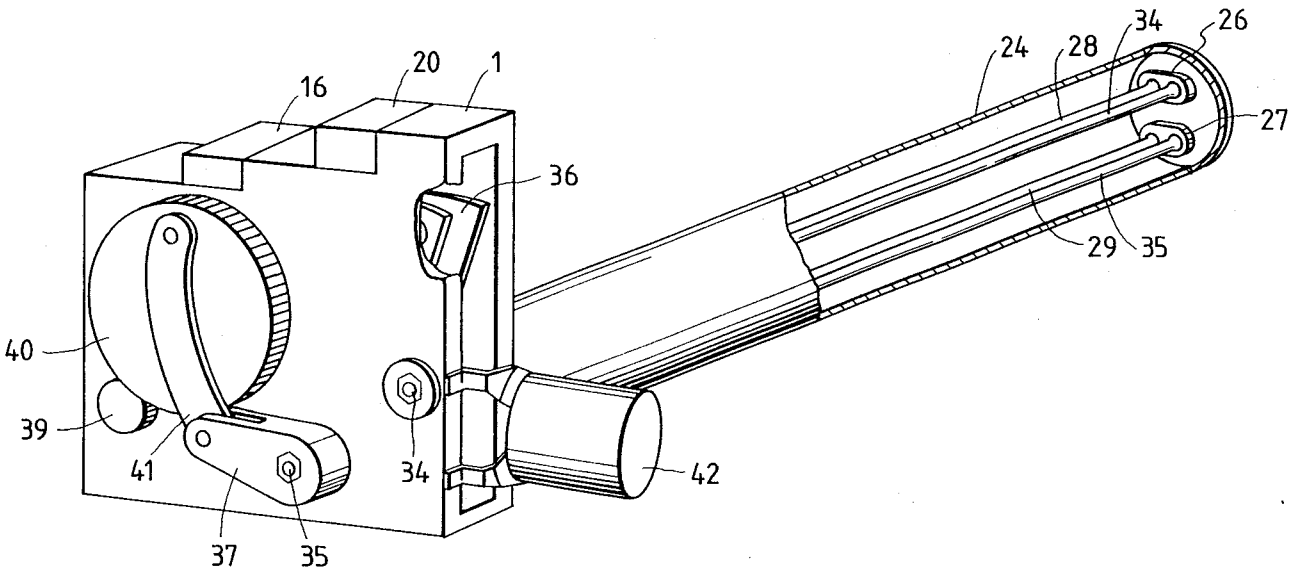
FIG. 2 is a perspective view of the switch operating mechanism shown in FIG. 1.
Figure 6:
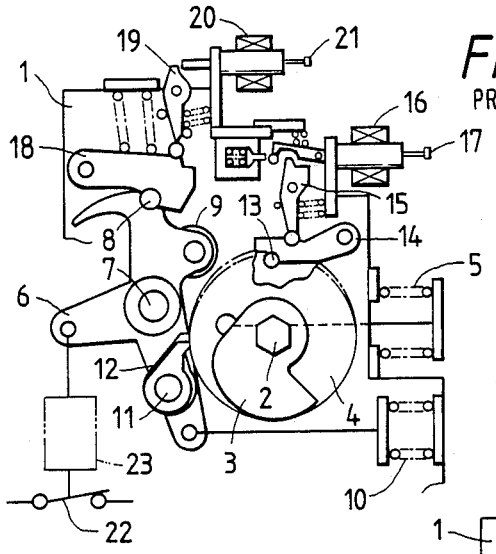
FIG. 6 PRIOR ART
FIG. 6 is an explanatory diagram showing a conventional switch operating mechanism.
Figure 7:
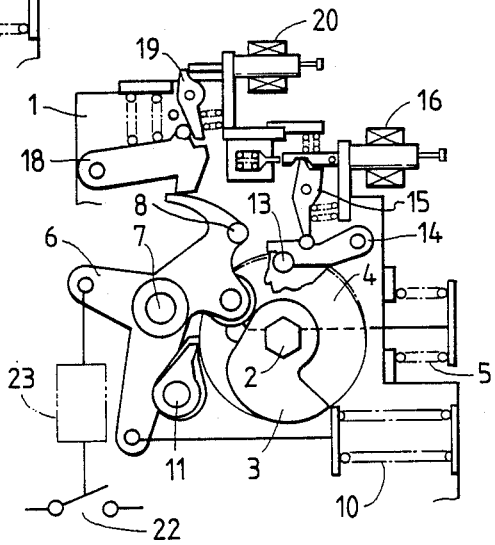
FIG. 7 PRIOR ART
FIGS. 7 and 8 are explanatory diagrams for a description of the operation of the switch operating mechanism shown in FIG. 6.
Figure 8:
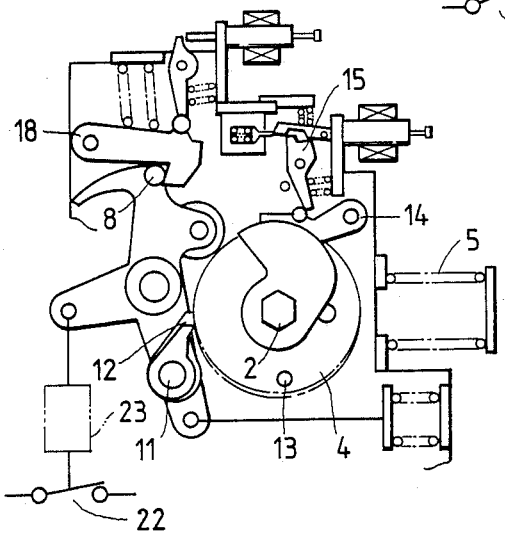
FIG. 8 PRIOR ART

In FIGS. 1 through 3, reference numerals 1, 2, 3, 8, 9, and 13 through 23 designate the same components as those of the conventional switch operating mechanism described with reference to FIGS. 6 through 8. Numeral 24 denotes a a cylinder secured to the housing 1. The pins 25 are embedded in the cylinder 24. Numerals 26 and 27 denote levers rotatably engaged with the pins 25, respectively. Numerals 28 and 29, denote torsion bars having first ends secured to the housing 1 and the remaining second ends secured respectively to the levers 26 and 27. Numerals 30 and 31 denote bearings coupled to the housing 1. A pair of rotary shafts 32 and 33 are supported by the bearings 30 and 31, respectively. Numerals 34 and 35 denote torsion bars having first ends secured to the rotary shafts 32 and 33 and the remaining second ends secured to the levers 26 and 27, respectively.

The torsion bars 28, 29, 34 and 35 are to obtain and elastic load through a torsional force. On the other hand, a coil spring utilizes the torsional force of the element wire; that is, the element wire is coiled, so that its end's linear motion provides an elastic load. Accordingly, the coil spring has the polar inertial moment of the element wire itself, and the inertial mass of the coil spring itself (about $\frac{1}{3}$ of the total mass of the coil spring) when cantilevered. Therefore, the natural frequency of the coil spring is small. On the other hand, the torsion bar has only the polar inertial moment of the spring itself, and therefore its natural frequency is large. In other words, in operating the movable contactor in the arc-extinguishing chamber, in the case of the coil spring, energy for operating the coil spring itself is additionally required. Furthermore, the torsion bar is advantageous in that it is free from the concentration of stress, and can be sufficiently set up in advance. However, in practice, it is rather difficult to suitably arrange and install the long torsion bar, and therefore the torsion bar has not been applied to the circuit breaker.

The torsion bars 28, 29, 34 and 35 are similar in design. However, in the invention, the angle of deflection of the breaking torsion bars is made smaller than that of the making torsion bars, so that the energy of deenergization of the making torsion bars in greater than that of the breaking torsion bars. A making force required in the switch making operation can be freely selected by changing the configuration of the cam 3.

Further in FIGS. 1, 2 and 3, reference numeral 36 designates a lever mounted fixedly on the rotary shaft 32, the lever 36 being urged to turn counterclockwise in FIG. 1 by the torsion bars 28 and 34. A lever 37 is fixedly secured to the rotary shaft 33. A rotary shaft 38 is support on the housing 1, the rotary shaft 38 being turned counter-clockwise in FIG. 1 by and electric motor (not shown). A small gear 39 is fixedly mounted on the rotary shaft 38, and a large gear 40 is fixedly mounted on the cam shaft 2. The large gear 40 is engaged with the small gear 39. A part of the periphery of the large gear 40 has no teeth so that, when the torsion bars 29 and 35 are energized, the large gear 40 is disengaged from the small gear 39.

Further in FIGS. 1, 2 and 3, reference numeral 41 designates a link coupling the lever 37 to the large gear 40. A shock absorber 42 is coupled to the lever 36. The shock absorber 42 is adapted to absorb the shock which may be caused when the movable contactor 22 is operated.

The operation of the switch operating mechanism thus constructed will be described.

Figure 4:
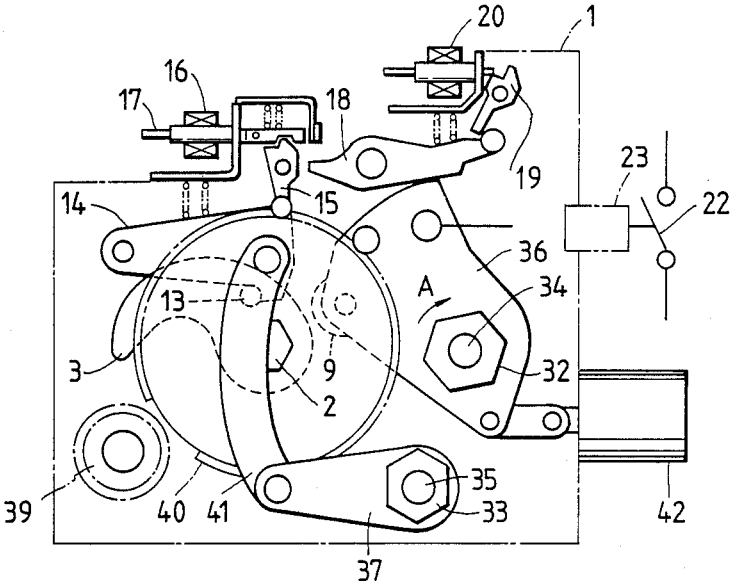
FIG. 4 is an explanatory diagram showing the switch operating mechanism which is operated to open the circuit.

First, the circuit opening operation will be described. In FIGS. 1 through 3, counterclockwise torque is given to the lever 36 by the torsion bars 28 and 34 at all times, and the torque is maintained by means of the tripping latch 18 and the tripping trigger 19. Therefore, when, under this condition, the tripping electromagnet 20 is energized, the plunger 21 is moved to the right to turn the tripping trigger 19 clockwise, as a result of which the tripping latch 18 is turned counterclockwise by the reaction of the pin 8. As the tripping latch 18 is disengaged from the pin 8, the lever 36 is turned counterclockwise to move the movable contactor 22 in the arc extinguishing chamber to open the circuit. Thus, the circuit opening operation has been accomplished as shown in FIG. 4.

Now, the circuit closing operation will be described. In FIG. 4, the cam 3, being coupled through the cam shaft 2, the large gear 40 and the link 41 to the lever 37, is urged to turn clockwise by means of the torsion bars 29 and 35. The torque maintained is applied to the cam 3 by means of the making latch 14 and the making trigger 15. When, under this condition, the making electromagnet 16 is energized, the plunger 17 is moved to the right to turn the making trigger 15 clockwise, as a result of which the making latch 14 is turned counterclockwise by the reaction of the pin 13 embedded in the cam 3. That is, the making latch 14 is disengaged from the pin 13, and the cam 3 is turned clockwise to push the roller 9 of the lever 36 upwardly. As a result, the lever 36 is driven while twisting the torsion bars 28 and 34 clockwise.

Figure 5:
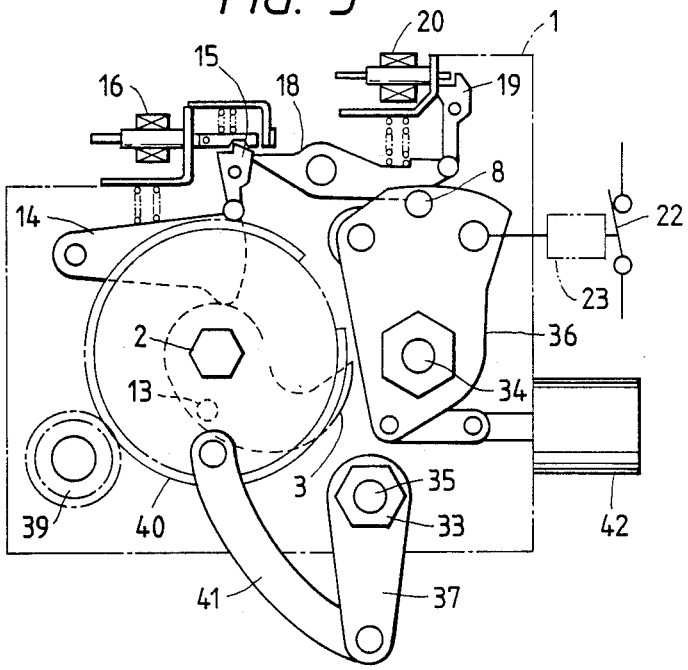
FIG. 5 is an explanatory diagram showing the switch operating mechanism which is operated to close the circuit.

FIG. 5 shows a state of the switch operation mechanism in which the switch making operation has been accomplished, and the pin 8 is held by the tripping latch 18 again. While the torsion bars 28 and 34 are being energized, the torsion bars 29 and 35 are deenergized. Therefore, the energy of energization of the torsion bars 29 and 35 is greater than that of the torsion bars 28 and 34.

The operation of energization of the torsion bars 29 and 35 is as follows: As shown in FIG. 5, when the circuit closing operation has been accomplished, the torsion bars 29 and 35 are held deenergized. The small gear 39 is coupled through the gear (not shown) to the motor. Therefore, as the small gear 39 is turned counterclockwise, the large gear 40 is turned clockwise, as a result the torsion bars 29 and 35 are energized through the link 41, the lever 37, and the making rotary shaft 33. When the direction of the tensile load of the link 37 goes over the dead point crossing the center of the cam shaft 2, the cam shaft 2 is urged to turn clockwise through the link 37 by the torsion bars 29 and 35, whereas the large gear 40 and the small gear 39 are disengaged from each other because the part of the periphery of the large gear 39 has no teeth as was described before. The clockwise torque given to the large gear by the torsion bars 29 and 35 is held by the engagement of the pin 13 with the making latch 14. That is, the state shown in FIG. 1 is obtained again. Under this condition, the large gear 40 idles since it is not engaged with the small gear 39. Thus, the torque of the motor is not transmitted to the large gear 40 and the latch 14 and the pin 13 are prevented from being overloaded.

The arrangement, installation and operation of the torsion bars will be described with reference to FIGS. 3 and 4.

In FIG. 4, as the lever 36 is turned in the direction of the arrow A (clockwise), the torsion bar 34 is twisted. In this operation, since the pivot pin 25 and the torsion bar 34 are not coaxial, while the torsion bar 34 is being twisted the one end of the torsion bar 34 is turned about the pin 25. That is, the torsion bar 34 is bent while being twisted. More specifically, a bending stress and a twisting stress are applied to the torsion bar 34 simultaneously. However, the bending stress may be disregarded, because the torsion bar is sufficiently long, and the amount of deflection due to bending is very small at the end portion.

As the lever 26 turns about the pin 25, the torsion bar 28 is twisted while its end portion is being turned about the pin 25. That is, similarly as in the case of the torsion bar 34, the torsion bar 28 is bent while being twisted. Accordingly, the torsion bars 28 and 34 act as one longer torsion bar. The supporting load of the torsion bar 34 and the supporting load of the torsion bar 28 are applied to the pin 25; however, they are cancelled out by each other because they are opposite in direction to each other. Thus, principally, no load is applied to the pin 25. If the pin 25 is slightly shifted from its ideal position, then the bending loads of the torsion bars are partially applied thereto. The supporting loads are small, and the loss of energy at the pins is also small. A torsion bar which is bent in use is applied for instance to an automobile's stabilizer; however, it should be noted that the torsion bars of the invention are completely different both in construction and in function from that. In order to improve the torsion bars so that bending loads may not be applied them, it is necessary to make the distance between the torsion bars 28 and 34 as short as possible. The distance may be zeroed by replacing one of the torsion bars with a pipe-shaped torsion bar. To form the pipe-shaped torsion bar is not economical, and not advisable from the technical view point; however, to do so is principally possible. If it is possible, then the object can be sufficiently achieved.

It order to obtain this structure with one torsion bar, it is necessary to fixedly hold its outer end. That is, the outer end of the torsion bar is positioned away from the operating mechanism, and accordingly it may be necessary to extend a long rigid member from the frame. However, in the switch operating mechanism of the invention, two torsion bars are employed in such a manner that one torsion bar doubles back over a portion of the distance spanned by the other torsion bar. Therefore, the outer ends thereof are closer to the frame. This will contribute to a reduction of the size of the switch operating mechanism.

In the above-described embodiment, two torsion bars are connected through the lever to form one longer torsion bar. The same effect can be obtained in the case where more than two torsion bars are connected in the same manner.

While the invention has been described with reference to the circuit breaker, it should be noted that the technical concept of the invention is applicable to interrupters or other switching devices.

The above-described method in which a plurality of torsion bars are connected into one long torsion bar for compactness in structure is applicable for instance to automobiles.

As was described above, in the switch operating mechanism of the invention, the torsion bar is employed in the drive source thereof, and it is divided into a plurality of parts. Thus, the switch operating mechanism is compact, and can operate at high speed.

What is claimed is:

1. A switch operating mechanism for operating a movable contactor (22) of a circuit breaker, said mechanism comprising:

a stationary housing (1);

a link means (23, 36) connected to said movable contactor (22);

a circuit breaking spring means for opening said movable contactor (22) including a first torsion bar (28) and a second torsion bar (34), said first torsion bar (28) having a first end which is fixedly secured to a first rotatable member (26), and a second end which is fixedly secured to said stationary housing (1), said second torsion bar (34) having a third end which is fixedly secured to said first rotatable member (26) in such a manner that said third end is disposed diametrically opposite to said first end of said first torsion bar (28), and a fourth end which is rotatably supported by said stationary housing (1) and coupled to said link means (23, 36).

2. A switch operating mechanism according to claim 1, further comprising a circuit making spring means for closing said movable contactor (22) and energizing said circuit breaking spring means including a third torsion bar (29) and a fourth torsion bar (35), said third torsion bar (29) having a fifth end which is fixedly secured to a second rotatable member (27), and a sixth end which is fixedly secured to said stationary housing (1), said fourth torsion bar (35) having a seventh end which is fixedly secured to said second rotatable member (27) in such a manner that said seventh end is disposed diametrically opposite to said fifth end of said third torsion bar (29), and an eighth end which is rotatably supported by said stationary housing (1) and coupled to a cam (3), wherein said cam (3) is engageable with said link means (23, 36) to close said movable contactor (22).

* * * * *